US005266054A

United States Patent [19]

Duncan et al.

[11] Patent Number: 5,266,054

[45] Date of Patent: Nov. 30, 1993

[54] SEALED AND FILTERED HEADER RECEPTACLE

[75] Inventors: Frank L. Duncan, Madison; Donald W. K. Hughes, Kernersville, both of N.C.

[73] Assignee: The Whitaker Corporation, Wilmington, Del.

[21] Appl. No.: 995,614

[22] Filed: Dec. 22, 1992

[51] Int. Cl.[5] ..... H01R 13/66

[52] U.S. Cl. ..... 439/620; 439/559

[58] Field of Search ..... 439/620, 609, 95, 559, 439/936

[56] References Cited

U.S. PATENT DOCUMENTS

| | | | |
|---|---|---|---|
| 4,335,932 | 6/1982 | Herrmann, Jr. | 339/218 M |
| 4,729,743 | 3/1988 | Farrar et al. | 439/276 |
| 4,960,391 | 10/1990 | Beinhaur et al. | 439/559 |
| 4,983,935 | 1/1991 | Mouissie | 333/184 |
| 5,018,989 | 5/1991 | Black et al. | 439/620 |
| 5,032,085 | 7/1991 | Alwine et al. | 439/936 X |
| 5,147,223 | 9/1992 | Black et al. | 439/620 |
| 5,152,699 | 10/1992 | Pfeifer | 439/620 |

FOREIGN PATENT DOCUMENTS

| | | | |
|---|---|---|---|
| 3731413 | 3/1989 | Fed. Rep. of Germany | 439/95 |

*Primary Examiner*—Eugene F. Desmond
*Attorney, Agent, or Firm*—Bruce J. Wolstoncroft

[57] ABSTRACT

An electrical header receptacle (10) is provided to be connected to a printed circuit board (11) and to be mounted in an enclosure (12). A housing (13) has a well (20) formed on the first side (16) of the base (15) of the housing (13). A metal shield (25) covers the second side (17) of the base (15) and is crimped over the base (15) so that a portion of the metal shield (15) covers a portion of the first side (16) of the base (15). A plurality of spaced-apart male contact pins (14) extend through respective openings in the metal shield (25) and base (15) exiting from the well (20) in the base (15). A sealant (33) is disposed in the well (20) and forms a waterproof seal about the plurality of male contact pins (14). The male contact pins (14) extend outwardly from the metal shield (25) and pass through an electromagnetic interference filter (35) and are connected to the printed circuit board (11). The plurality of male contact pins (14) are joined to the electromagnetic filter (35) to prevent passage of electromagnetic interferences therethrough. The electromagnetic filter (35) may be mounted vertically or horizontally with respect to the metal shield (25) and is electrically connected to the metal shield (25). A flange seal (40) is disposed between the first side (16) of the base (15) and the enclosure (12) to provide a waterproof seal. The portion of the metal shield (25) on the first side (16) of the base (15) makes electrical contact with the enclosure (12).

13 Claims, 3 Drawing Sheets

SEALED AND FILTERED HEADER RECEPTACLE

The present invention relates to an electrical header receptacle assembly, and more particularly to a waterproof header receptacle with electrical filtering and shielding properties.

BACKGROUND OF THE INVENTION

The installation of electronic equipment frequently utilizes electrical header receptacle assemblies between separate components of the equipment. Sometimes, the header receptacle assembly needs to be waterproof to assure the integrity of the electrical circuit. Also, the header receptacle assembly may require shielding and filtering of the circuit from electromagnetic interferences.

SUMMARY OF THE INVENTION

The present invention provides a waterproof electrical header receptacle assembly which is protected against electromagnetic interferences.

In accordance with the teachings of the present invention, there is disclosed herein a sealed and filtered electrical header receptacle to be connected to a printed circuit board and to be mounted in an enclosure. The receptacle has a housing, and a plurality of spaced-apart male contact pins between the housing and the printed circuit board. The housing has a base which has a first side and a second side. Surrounding walls being formed on the first side of the base. The base extends outwardly in a plane substantially perpendicular to the surrounding walls. A well is formed on the first side of the base, the well being enclosed by the surrounding walls. A metal shield is disposed over the second side of the base of the housing. The metal shield extends beyond the second side of the base and is crimped over the first side of the base so as to cover a portion of the first side of the base. A plurality of spaced-apart openings in the metal shield are aligned with a corresponding plurality of spaced-apart openings formed through the base of the housing. The plurality of openings terminate in the well in the first side of the base. The plurality of spaced-apart male contact pins are received in the respective plurality of spaced-apart openings in the metal shield and in the base of the housing. The male contact pins each have a first end which extends into the housing and is enclosed by the surrounding walls on the base. Each male contact pin has a second end which extends outwardly and substantially perpendicularly from the metal shield. A sealant is disposed in the well in the first side of the base of the housing, the sealant forming a waterproof seal on the base of the housing and about each of the male contact pins which extend therethrough. An electromagnetic interference filter is disposed adjacent to the metal shield and is in electrical contact with the metal shield. The plurality of male contact pins extend through the electromagnetic interference filter and the respective second ends of the pins are connected to the printed circuit board. Means are provided for attaching the plurality of male contact pins to the electromagnetic filter to prevent the passage of electromagnetic interference therethrough. A flange seal is disposed on the first side of the base of the housing externally of the surrounding walls. Means are provided for mounting the base of the housing in the enclosure wherein the metal shield is electrically connected to the enclosure and the flange seal provides a moisture proof seal between the base of the housing and the enclosure.

These and other objects of the present invention will become apparent from a reading of the following specification, taken in conjunction with the enclosed drawings.

DETAILED DESCRIPTION OF THE PREFERRED EMBODIMENTS

Figure 1:
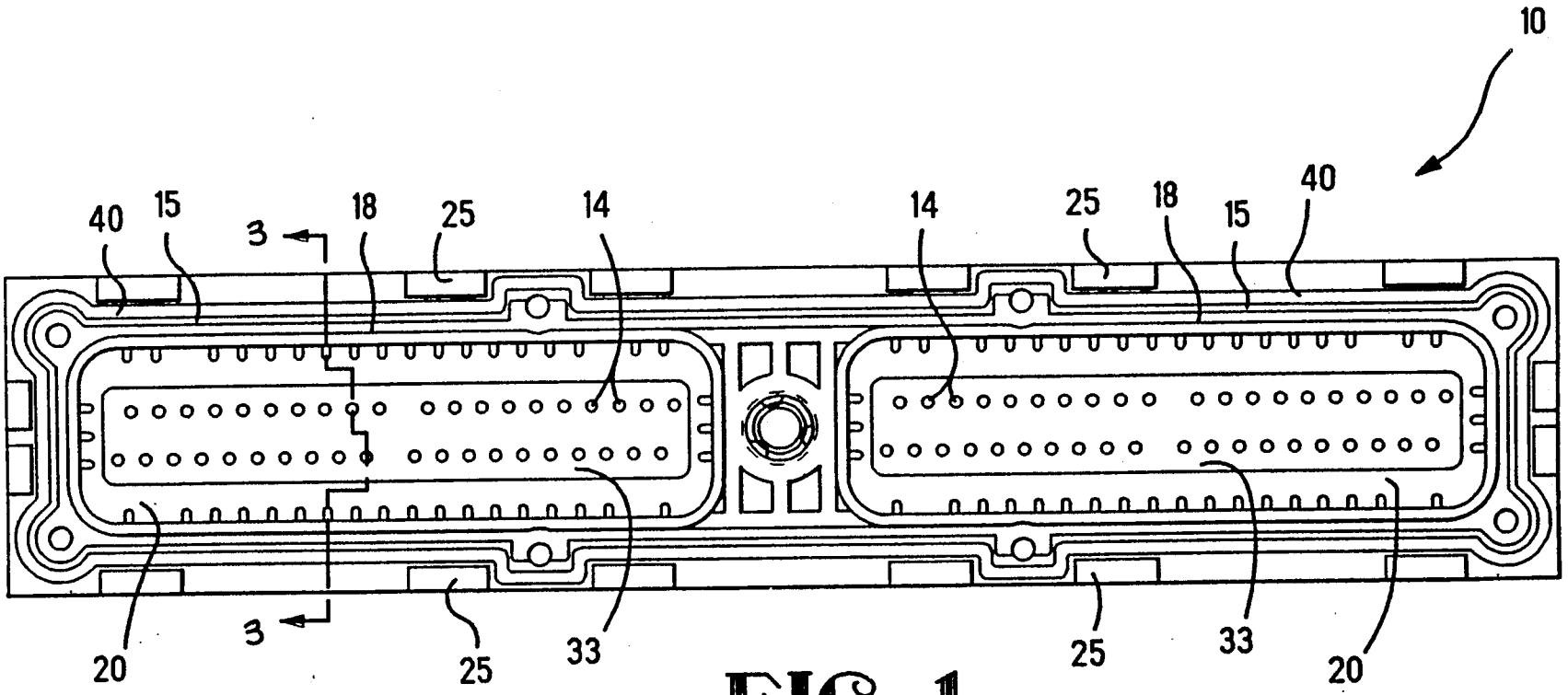
FIG. 1 is a front view of the electrical header receptacle assembly of the present invention.
Figure 2:
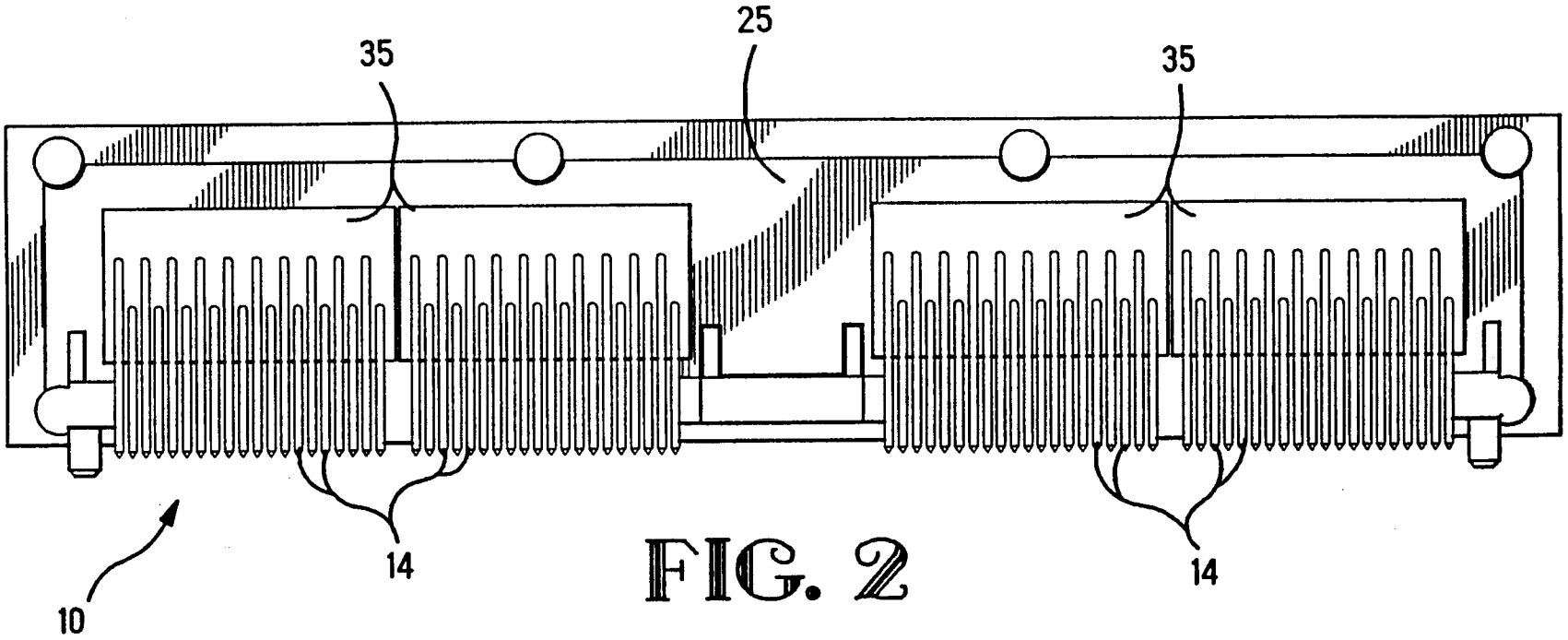
FIG. 2 is a back view of the electrical header receptacle assembly of the present invention.
Figure 3:
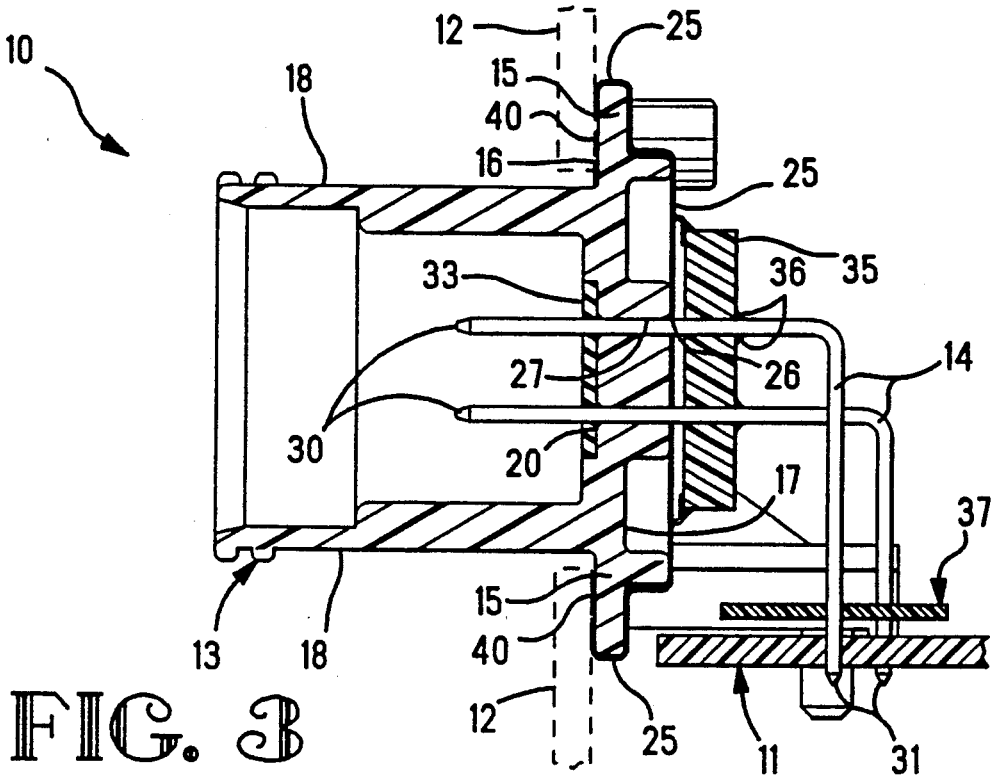
FIG. 3 is a cross-sectional view taken across the lines 3—3 of FIG. 1 showing the electromagnetic interference filter in a vertical position.
Figure 4:
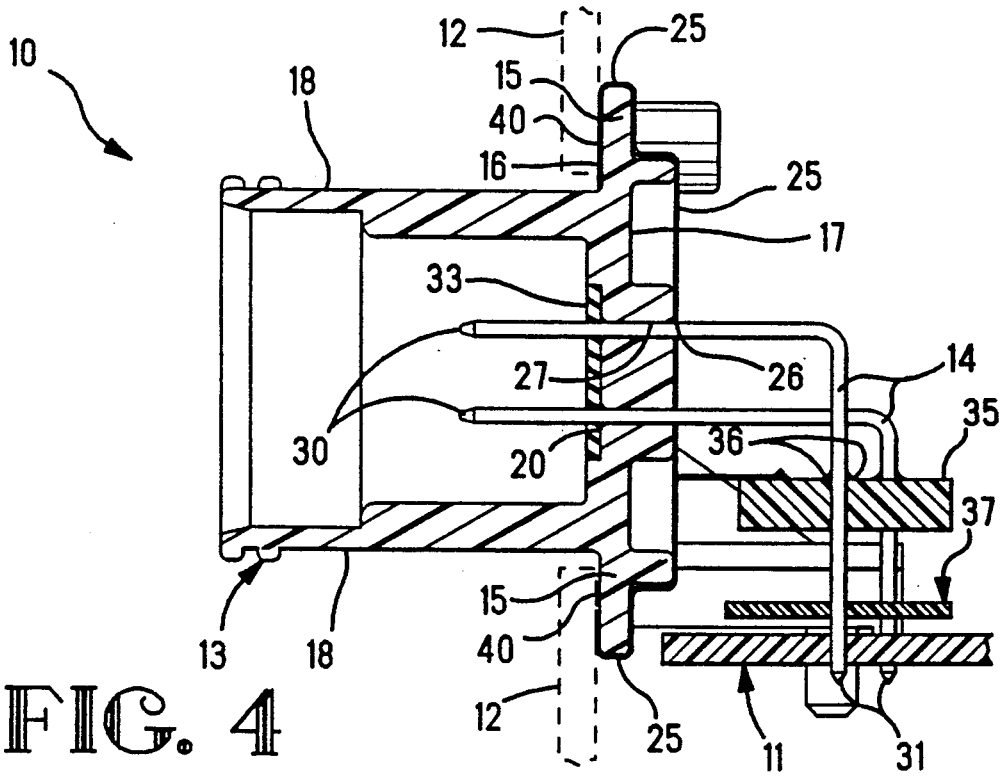
FIG. 4 is a cross-sectional view taken across the lines 3—3 of FIG. 1 showing the electromagnetic interference filter in a horizontal position.

With reference to FIGS. 1–4, an electrical header receptacle assembly 10 is shown. The electrical header receptacle 10 is connected to a printed circuit board 11 and is mounted in an enclosure 12. The electrical header receptacle 10 has a housing 13 and a plurality of spaced-apart male contact pins 14 between the housing 13 and the printed circuit board 11.

The housing 13 has a base 15 which has a first side 16 and a second side 17. On the first side 16 of the base 15 are formed surrounding walls 18. The walls 18 are in an open box-like shape with the base 15 forming the bottom of the box. The base 15 extends outwardly in a plane substantially perpendicular to the walls 18. A well 20 is formed on the first side 16 of the base 15. The well 20 is completely enclosed by the surrounding walls 18. Preferably, the housing 13 is made of plastic which is an electrical insulator.

A metal shield 25 is disposed over the second side 17 of the base 15 of the housing 13. The metal shield 25 completely covers and extends beyond the entire second side 17 of the base 15 and is crimped over the base 15 such that a portion of the metal shield 25 covers a portion of the first side 16 of the base 15.

The metal shield 25 has a plurality of spaced-apart openings 26 formed in the shield 25. A corresponding plurality of spaced-apart openings 27 are formed in the base 15 of the housing 13. The plurality of openings 27 in the base extend completely through the base 15 and terminate in the well 20 on the first side 16 of the base 15. The plurality of openings 26 in the shield 25 are aligned with the plurality of openings 27 in the base 15. The plurality of spaced-apart male contact pins 14 are received in the plurality of openings 26 in the shield 25 and in the plurality of openings 27 in the base 15. The first end 30 of each male contact pin 14 extends through the well 20 in the first side 16 of the base 15 and into the housing 13 such that the first ends 30 of each of the male contact pins 14 are surrounded by the walls 18 on the first side 16 of the base 15. The male contact pins 14 further extend outwardly, and preferably substantially perpendicularly, from the metal shield 25 which covers the second side 17 of the base 15.

A sealant 33 is disposed in the well 20 on the first side 16 of the base 15. Preferably, the sealant 33 is a material which is cured by ultraviolet radiation. In this manner, the sealant 33, in liquid form, may be disposed in the well 20 so as to completely envelope each of the male contact pins 14 in the well 20. Curing of the sealant 33 in situ provides a rapid, convenient and effective means to provide a waterproof seal about each of the male contact pins 14 and the openings 27 in the base 15.

An electromagnetic interference filter 35 is mounted adjacent to the metal shield 25. An electrical connection is provided between the ground of the filter 35 and the metal shield 25. The plurality of male contact pins 14 pass through the electromagnetic interference filter 35. Each male contact pin 14 is attached to the electromagnetic interference filter 35 to prevent the entry of electromagnetic interferences. Preferably, each male contact pin 14 is soldered to the filter 35 at a solder junction 36 although other means known to persons skilled in the art may be used. The electromagnetic interference filter 35 may be mounted in either a vertical position (FIG. 3) or a horizontal position (FIG. 4) with respect to the metal shield 25. The vertical mounting maximizes the effectiveness of the filter 25 by its being immediately alongside of the metal shield 25. The horizontal mounting is used with a Pi circuit (a portion of the circuit on the header receptacle and portion of the circuit on the printed circuit board). The horizontal mounting provides processing access to the solder junction 36 between the male contact pin 14 and the electromagnetic filter 35.

The respective second ends 31 of the male contact pins 14 are connected to the printed circuit board 11 to complete the electrical circuit. If desired, a pin guide 37 may be provided to align and better secure the plurality of male contact pins 14.

A flange seal 40 is disposed on the first side 16 of the base 15 externally of the walls 18. The flange seal 40 provides a moisture proof seal between the base 15 of the housing 13 and the enclosure 12 when the electrical header receptacle 10 is mounted in the enclosure 12. The mounting means may be screws, studs or other mechanical fastening means. When the base 15 is mounted in the enclosure 12, the portion of the metal shield 25 which covers a portion of the front side 16 of the base 15 is in electrical contact with the enclosure 12 so that the metal shield 25 is grounded to suppress electromagnetic interferences.

In this manner an electrical header receptacle is provided which is waterproof and is protected against electromagnetic interferences.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In an electrical header receptacle assembly to be connected to a printed circuit board and to be mounted in an enclosure, the combination of a housing having a first side and a second side, a well being formed in the first side of the housing, a plurality of spaced-apart male contact pins, a metal shield, and an electromagnetic interference filter;

the metal shield covering the second side of the housing, the metal shield being crimped over a portion of the first side of the housing;

the male contact pins being connected to the printed circuit board, the male contact pins passing, in sequence, through the electromagnetic interference filter, through the metal shield and through the housing, the male contact pins exiting through the well in the first side of the housing and extending outwardly therefrom;

means for sealing the plurality of male contact pins in the well in the first side of the housing to prevent passage of moisture therethrough;

means for electrically connecting the electromagnetic interference filter to the metal shield;

means for attaching the plurality of male contact pins to the electromagnetic interference filter to prevent passage of electromagnetic interferences therethrough;

means for mounting the housing in the enclosure, wherein electrical contact is effected between the metal shield on the housing and the enclosure and further, wherein a moisture proof seal is formed between the housing and the enclosure;

such that the electrical header receptacle assembly is moisture proof and electromagnetic interferences are suppressed.

2. The electrical header receptacle assembly of claim 1, wherein a sealant is disposed in the well on the first side of the housing to seal the plurality of male contact pins therein.

3. The electrical header receptacle assembly of claim 2, wherein the sealant is cured in the well by exposure to ultraviolet radiation

4. The electrical header receptacle assembly of claim 1, wherein the electromagnetic interference filter is disposed substantially parallel to the metal shield thereby providing maximum protection against electromagnetic interferences.

5. The electrical header receptacle assembly of claim 1, wherein the male contact pins are soldered to the electromagnetic interference filter.

6. The electrical header receptacle assembly of claim 1, wherein a flange seal is disposed on the first side of the housing such that the flange seal provides a moisture proof closure between the enclosure and the housing.

7. The electrical header receptacle assembly of claim 1, wherein walls are formed on the first side of the housing, said walls enclosing the well and the male contact pins on said first side of the housing.

8. The electrical header receptacle assembly of claim 1, wherein a plurality of spaced-apart openings are formed in the metal shield and a corresponding plurality of spaced-apart openings are formed in the housing, the openings in the metal shield being aligned with the openings in the housing such that the plurality of male contact pins may pass through the respective openings.

9. In a sealed and filtered electrical header receptacle to be connected to a printed circuit board and to be mounted in an enclosure, the electrical header receptacle having a housing, and a plurality of spaced-apart male contact pins between the housing and the printed circuit board, the improvement comprising:

the housing having a base, the base having a first side and a second side, surrounding walls being formed on the first side of the base, the base extending outwardly in a plane substantially perpendicular to the surrounding walls, a well formed on the first side of the base, the well being enclosed by the surrounding walls;

a metal shield disposed over the second side of the base of the housing, the metal shield extending beyond the second side of the base and being crimped over the first side of the base so as to cover a portion of the first side of the base;

a plurality of spaced-apart openings in the metal shield aligned with a corresponding plurality of spaced-apart openings formed through the base of the housing, said plurality of openings terminating in the well in the first side of the base;

the plurality of spaced-apart male contact pins being received in the respective plurality of spaced-apart openings in the metal shield and in the base of the housing, wherein each male contact pin has a first end extending into the housing and being enclosed by the surrounding walls thereof and each male contact pin has a second end extending outwardly from the metal shield;

a sealant disposed in the well in the first side of the base of the housing, the sealant forming a waterproof seal thereon and about each of the male contact pins extending therethrough;

an electromagnetic interference filter disposed adjacent to the metal shield and in electrical contact with the metal shield;

the plurality of male contact pins extending through the electromagnetic interference filter and the respective second ends of said pins being connected to the printed circuit board;

means for attaching the plurality of male contact pins to the electromagnetic interference filter to prevent the entry of electromagnetic interference therethrough;

a flange seal disposed on the first side of the base of the housing externally of the surrounding walls; and means for mounting the base of the housing in the enclosure wherein the metal shield is electrically connected to the enclosure and the flange seal provides a moisture proof seal between the base of the housing and the enclosure.

10. The electrical header receptacle of claim 9, wherein the sealant disposed in the well in the first side of the base is cured by ultraviolet radiation.

11. The electrical header receptacle of claim 9, where the electromagnetic interference filter is disposed substantially parallel to the metal shield thereby providing maximum shielding to the header receptacle.

12. The electrical header receptacle of claim 9, wherein the electromagnetic interference filter is disposed substantially perpendicular to the metal shield to provide processing access to the junction between the male contact pins and the electromagnetic interference filter.

13. The electrical header receptacle of claim 9, wherein the male contact pins are soldered to the electromagnetic interference filter.

* * * * *